US011131452B1

(12) United States Patent
Jin et al.

(10) Patent No.: US 11,131,452 B1
(45) Date of Patent: Sep. 28, 2021

(54) LAMP CAP OF CHRISTMAS LAMP

(71) Applicant: LINHAI SHENCHENG CHRISTMAS LIGHT FACTORY, Linhai (CN)

(72) Inventors: Longjun Jin, Linhai (CN); Longcheng Jin, Linhai (CN)

(73) Assignee: LINHAI SHENCHENG CHRISTMAS LIGHT FACTORY, Linhai (CN)

( * ) Notice: Subject to any disclaimer, the term of this patent is extended or adjusted under 35 U.S.C. 154(b) by 0 days.

(21) Appl. No.: 17/144,531

(22) Filed: Jan. 8, 2021

(30) Foreign Application Priority Data

Sep. 9, 2020 (CN) ..... 202021961437.9

(51) Int. Cl.

| | |
|---|---|
| ***F21V 31/04*** | (2006.01) |
| ***F21V 17/16*** | (2006.01) |
| ***F21V 21/088*** | (2006.01) |
| ***F21V 17/10*** | (2006.01) |
| ***F21V 3/04*** | (2018.01) |
| ***F21S 4/10*** | (2016.01) |
| ***F21K 9/66*** | (2016.01) |
| ***F21V 3/06*** | (2018.01) |
| ***F21V 19/00*** | (2006.01) |
| ***F21Y 115/10*** | (2016.01) |

(52) U.S. Cl.

CPC ..... *F21V 31/04* (2013.01); *F21K 9/66* (2016.08); *F21S 4/10* (2016.01); *F21V 3/049* (2013.01); *F21V 3/062* (2018.02); *F21V 17/101* (2013.01); *F21V 17/16* (2013.01); *F21V 19/005* (2013.01); *F21V 21/088* (2013.01); *F21Y 2115/10* (2016.08)

(58) Field of Classification Search

CPC .. F21S 4/10; F21V 3/049; F21V 3/062; F21V 19/005; F21V 17/101; F21V 31/04

USPC ..... 362/653, 654

See application file for complete search history.

(56) References Cited

U.S. PATENT DOCUMENTS

| | | | | |
|---|---|---|---|---|
| 4,675,575 A * | 6/1987 | Smith | H05B 47/10 | 315/185 S |
| 5,184,890 A * | 2/1993 | Chen | A47G 33/0836 | 362/353 |
| 5,221,140 A * | 6/1993 | Oshino | F21V 9/08 | 362/255 |
| 5,499,174 A * | 3/1996 | Lin | F21S 4/10 | 362/311.06 |
| 5,626,415 A * | 5/1997 | Huang | F21V 3/00 | 362/267 |
| 6,630,773 B1 * | 10/2003 | Huang | F21V 3/00 | 313/318.02 |

(Continued)

*Primary Examiner* — William N Harris

(74) *Attorney, Agent, or Firm* — Bayramoglu Law Offices LLC

(57) ABSTRACT

A lamp cap of a Christmas lamp includes a lamp cap housing, and a potting wick assembly arranged in the lamp cap housing. The potting wick assembly includes a patch lamp board, a lead wire connected to the patch lamp board, a transparent outer housing, and a potting adhesive. At least one LED lamp bead is arranged on the patch lamp board. A receiving cavity is arranged in the transparent outer housing, and the patch lamp board is placed at a bottom of the receiving cavity. The lead wire is led out from one end of the receiving cavity, and the potting adhesive is potted into the receiving cavity.

10 Claims, 4 Drawing Sheets

(56) References Cited

U.S. PATENT DOCUMENTS

| | | | | |
|---|---|---|---|---|
| 8,070,347 | B1 * | 12/2011 | Lin | F21V 31/00 362/654 |
| 10,533,738 | B2 * | 1/2020 | Leung | F21V 3/00 |
| 2009/0129099 | A1 * | 5/2009 | Fan | F21V 31/00 362/368 |
| 2009/0251923 | A1 * | 10/2009 | Yu | F21V 31/005 362/653 |

* cited by examiner

LAMP CAP OF CHRISTMAS LAMP

CROSS REFERENCE TO THE RELATED APPLICATIONS

This application is based upon and claims priority to Chinese Patent Application No. 202021961437.9, filed on Sep. 9, 2020, the entire contents of which are incorporated herein by reference.

TECHNICAL FIELD

The present invention relates to lighting fixtures, and more particularly, to a lamp cap of a Christmas lamp.

BACKGROUND

Christmas lamps, such as artichoke lamps C7 and C9, are typically mounted with only one separate light-emitting diode (LED) lamp bead, and thus have insufficient brightness and low transmission of lamplight. Moreover, prior patch lamp boards are generally installed into a lamp cap housing or a lamp bulb housing directly, which makes the installation less than optimally stable and does not waterproof the connection. Therefore, it is highly desirable to provide an improved lamp cap, including an improved lamp cap of a Christmas lamp.

SUMMARY

An objective of the present invention is to provide a lamp cap of a Christmas lamp that is waterproof and provides substantially more, brighter light.

The objective of the present invention is implemented as follows. A lamp cap of a Christmas lamp includes a lamp cap housing, and a potting wick assembly arranged in the lamp cap housing. The potting wick assembly includes a patch lamp board, a lead wire connected to the patch lamp board, a transparent outer housing, and a potting adhesive. At least one LED lamp bead is arranged on the patch lamp board. A receiving cavity is arranged in the transparent outer housing, and the patch lamp board is placed at a bottom of the receiving cavity. The lead wire is led out from one end of the receiving cavity, and the potting adhesive is potted into the receiving cavity.

Further, an outer wall of the transparent outer housing is provided with a limiting snap ring.

Further, the transparent outer housing includes an enclosed light source scattering end, and an open end for potting. The light source scattering end has a convex mirror structure.

Further, a center positioning block or an edge positioning block is further arranged in the receiving cavity.

Further, the lamp cap housing includes a left housing and a right housing connected to each other, and the left housing and the right housing are fixed through ultrasonic welding.

Further, an inner cavity is formed between the left housing and the right housing. The inner cavity includes a lead wire cavity located on an upper part of the lamp cap housing, and a mounting cavity located at a lower part of the lamp cap housing. A positioning ring is arranged in the mounting cavity, and a joint between the lead wire cavity and the mounting cavity is provided with a step surface. A fixed cavity for fixing the limiting snap ring is formed between the step surface and the positioning ring.

Further, the mounting cavity is provided with an internal thread located below the positioning ring.

Further, the left housing or the right housing is provided with at least one ear-shaped clamping portion.

Further, the potting adhesive is a modified asphalt, and the modified asphalt includes the following components in parts by weight: 100 parts of asphalt, 5-10 parts of polyurethane resin, 8-10 parts of styrene-butadiene-styrene (SBS) rubber, 3-5 parts of inorganic fillers, 3-5 parts of tackifier by weight, 3-5 parts of softening oil by weight, 2-5 parts of antioxidant by weight, and 1-3 parts of nanofibers.

A production process for the lamp cap of the Christmas lamp includes the following steps:

step 1: manufacturing the potting wick assembly:

a. forming the transparent outer housing by pre-injection molding, wherein the transparent outer housing is formed from a polyvinyl chloride (PVC) material;

b. placing the patch lamp board at the bottom of the receiving cavity of the transparent outer housing;

c. enabling an adhesive potting gun by an adhesive potting apparatus to aim at an open end of the transparent outer housing and injecting the potting adhesive; and d. obtaining the finished product after naturally cooling and curing for five minutes;

step 2: manufacturing the lamp cap housing, and forming the left housing and the right housing matched with each other by pre-injection molding; and step 3: mounting the potting wick assembly into the lamp cap housing, and jointing the left housing and the right housing by ultrasonic welding.

By adopting the above technical solutions, the present invention has following advantages. The housing uses light transmission materials, and the top thereof adopts the principle of convex mirror, so as to make the light source more concentrated.

The patch lamp board is allowed to randomly increase the number of LED lamp beads to achieve the required brightness and beauty of lamplight;

The special modified asphalt is formed by being mixed with a certain proportion of additives, to achieve good insulation, good waterproof and sealing performance, high temperature resistance of 120° C., low temperature resistance of 50° C., small stress and good heat dissipation. Moreover, the special modified asphalt does not flow into the front of the LED patch lamp board during the potting process, thereby ensuring that the color of the LED light source is not changed.

The potting wick assembly and the lamp cap housing perform a double sealing function, and thus have good waterproof performance.

Furthermore, compared with that the current waterproof lamp caps on the market are not easy to mold a small structure by using the vertical injection molding technology, the present lamp cap can become more and more miniaturized, thereby reducing labor costs and material costs. The present invention has the increased shape variability and excellent product quality after the technical improvement, which is suitable for popularization and use.

In the figures: 1. potting wick assembly; 2. patch lamp board; 3. lead wire; 4. transparent outer housing; 5. potting adhesive; 6. LED lamp bead; 7. limiting snap ring; 8. light source scattering end; 9. left housing; 10. right housing; 11. positioning ring; 12. step surface; 13. ear-shaped clamping portion; 14. center positioning block; and 15. edge positioning block.

DETAILED DESCRIPTION OF THE EMBODIMENTS

Figure 1:
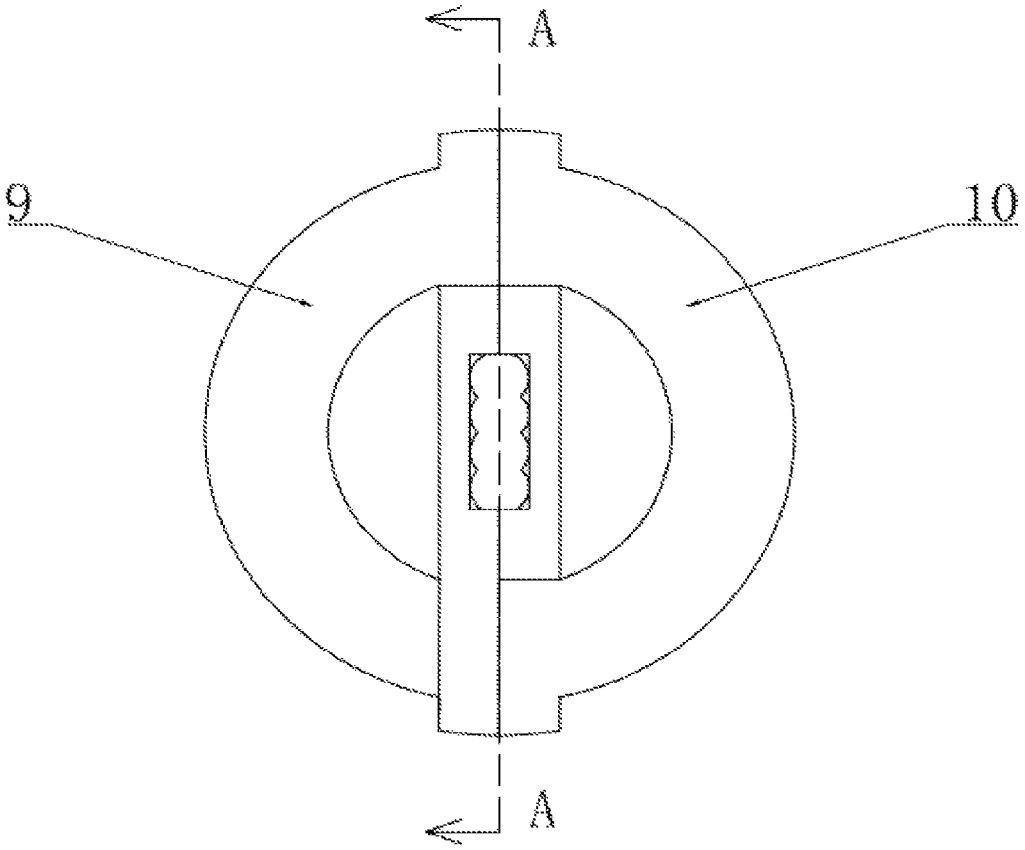
FIG. 1 is a schematic diagram of the structure of an embodiment of the invention.
Figure 2:
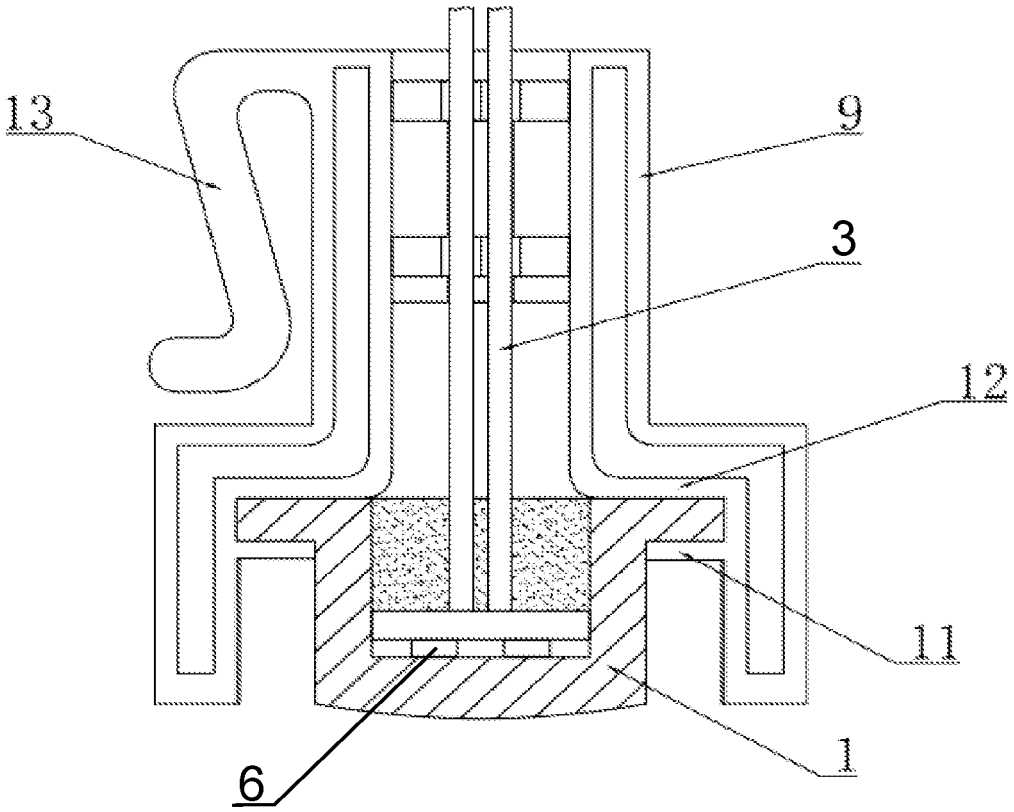
FIG. 2 is a cross-sectional view of the structure of FIG. 1 taken along line A-A.
Figure 3:
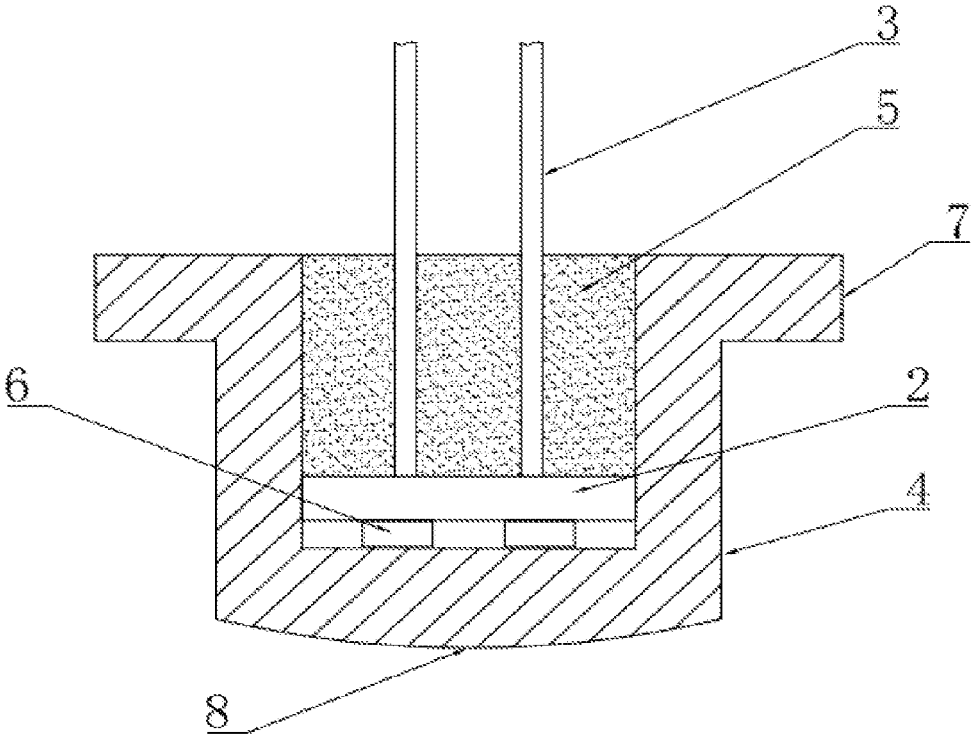
FIG. 3 is a schematic diagram of the structure of a potting wick assembly shown in FIG. 2 according to an embodiment of the invention.

The present invention is further described below in conjunction with the drawings and specific embodiments, referring to FIGS. 1-3:

A lamp cap of a Christmas lamp includes a lamp cap housing, and a potting wick assembly 1 arranged in the lamp cap housing. The potting wick assembly 1 includes a patch lamp board 2, a lead wire 3 connected to the patch lamp board 2, a transparent outer housing 4, and a potting adhesive 5. At least one LED lamp bead 6 is arranged on the patch lamp board 2. A receiving cavity is arranged in the transparent outer housing 4, and the patch lamp board 2 is placed at a bottom of the receiving cavity. The lead wire 3 is led out from one end of the receiving cavity, and the potting adhesive 5 is potted into the receiving cavity.

By adopting the above structure, it is achieved to perform a good sealing and waterproof function for the patch lamp board 2, and the number of LED lamp beads 6 can be increased in the patch lamp board 2 of the present structure to achieve the required brightness and beauty of lamplight.

The outer wall of the transparent outer housing 4 is provided with the limiting snap ring 7, and the limiting snap ring 7 facilitates the transparent outer housing 4 to be fixed in the lamp cap housing.

The transparent outer housing 4 includes the enclosed light source scattering end 8, and the open end for potting. The light source scattering end 8 has a convex mirror structure, and the convex mirror structure enables the light source to be concentrated and have optimal brightness.

Figure 4:
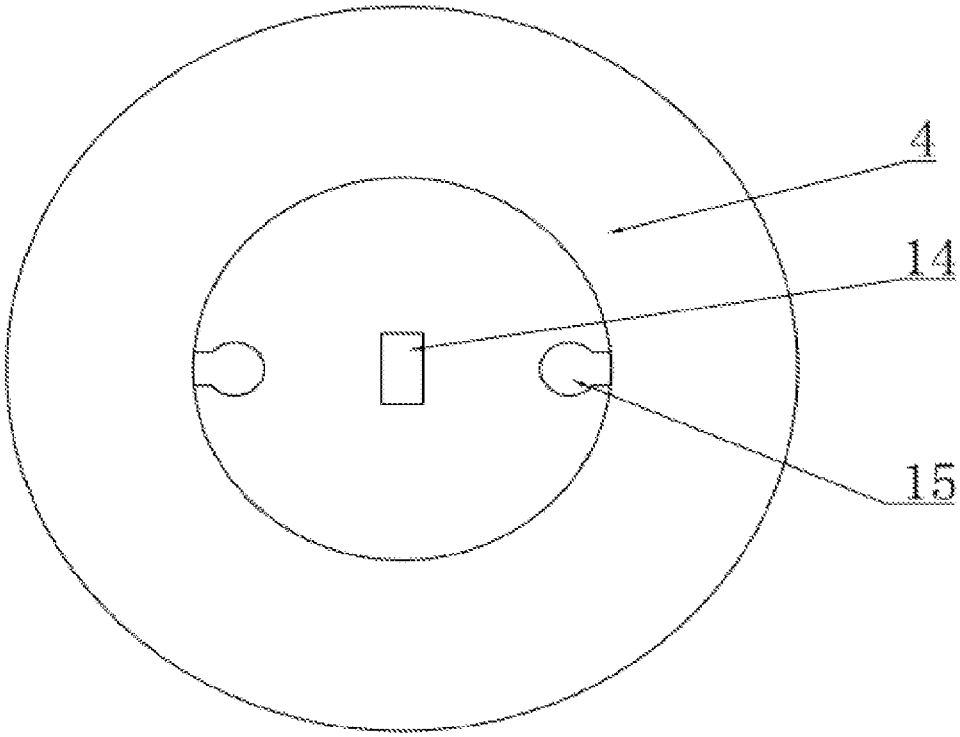
FIG. 4 is a schematic diagram of the structure inside the receiving cavity shown in FIG. 3 according to an embodiment of the invention.

As shown in FIG. 4, the center positioning block 14 or the edge positioning block 15 is further arranged in the receiving cavity, and the center positioning block 14 or the edge positioning block 15 is located at the bottom of the receiving cavity. After the patch lamp board 2 is installed, the patch lamp board 2 axially abuts against the center positioning block, so as to position the installation height. Alternatively, the patch lamp board 2 is further provided with a notch for engaging with the edge positioning block, so as to realize a limiting function. In such ways, the installation stability of the patch lamp board is improved.

The lamp cap housing includes the left housing 9 and the right housing 10 connected to each other, and the left housing 9 and the right housing 10 are fixed through ultrasonic welding.

The lamp cap housing includes left and right split-type housings, which is convenient for the installation and fixation of the potting wick assembly 1. In addition, the lamp cap housing is sealed and connected by means of ultrasonic welding, and thus is waterproof and has an optimal sealing performance.

An inner cavity is formed between the left housing 9 and the right housing 10. The inner cavity includes a lead wire cavity located on the upper part of the lamp cap housing, and a mounting cavity located at the lower part of the lamp cap housing. The positioning ring 11 is arranged in the mounting cavity, and a joint between the lead wire cavity and the mounting cavity is provided with the step surface 12. A fixed cavity for fixing the limiting snap ring 7 is formed between the step surface 12 and the positioning ring 11.

The potting wick assembly 1 is mounted in the mounting cavity, and is positioned axially and radially through the fixed cavity. In this way, the stability of the installation structure is made optimal.

The mounting cavity is provided with an internal thread located below the positioning ring 11, and the internal thread facilitates the connection, fixation and disassembly between the lamp cap and the lamp housing.

The left housing 9 or the right housing 10 is provided with at least one ear-shaped clamping portion 13, and the ear-shaped clamping portion 13 facilitates the suspension and fixation of the lamp cap.

The potting adhesive 5 is a modified asphalt, and the modified asphalt includes the following components in parts by weight: 100 parts of asphalt, 5-10 parts of polyurethane resin, 8-10 parts of SBS rubber, 3-5 parts of inorganic fillers, 3-5 parts of tackifier by weight, 3-5 parts of softening oil by weight, 2-5 parts of antioxidant by weight, and 1-3 parts of nanofibers.

The inorganic filler is at least one selected the group consisting of magnesium carbonate, calcium carbonate, talcum powder and aluminum oxide.

On the basis of taking petroleum asphalt as a raw material, the modified asphalt is formed by mixing the petroleum asphalt with a plurality of additives. Compared with the prior asphalt, a softening point of the modified asphalt is improved, and the stress generated during the conversion of liquid to solid is reduced. Meanwhile, the heat dissipation ability of the modified asphalt is greatly increased to enable it to have the necessary conditions for potting electronic components.

The potting adhesive 5 prepared according to the above components is detected through experiments, and has the following performance parameters: a softening point is greater than 123° C., a heat conductivity coefficient is greater than 0.7 W/M·k, a shrinkage rate after potting is less than 0.7, a dielectric strength is greater than 23 KV/mm/1 min, a penetration degree is 1.4-2.2 mm/25° C., and a flash point is greater than 280° C.

A production process of the lamp cap of the Christmas lamp includes the following steps.

Step 1: the potting wick assembly 1 is manufactured:

a. the transparent outer housing 4 is formed by pre-injection molding, and the transparent outer housing 4 is formed from a PVC material;

b. the patch lamp board 2 is placed at the bottom of the receiving cavity of the transparent outer housing 4;

c. an adhesive potting apparatus enables an adhesive potting gun to aim at an open end of the transparent outer housing 4 and injects the potting adhesive 5, and the potting temperature is 140° C. to 150° C.; and d. a finished product is obtained after naturally cooling and curing for five minutes.

Step 2: the lamp cap housing is manufactured, and the left housing 9 and the right housing 10 matched with each other are formed by pre-injection molding.

Step 3: the potting wick assembly 1 is mounted into the lamp cap housing, and ultrasonic welding joins the left housing 9 and the right housing 10.

The special potting adhesive 5 is selected, the potting process is simple, and it can be cooled and solidified naturally in about 5 minutes. The black adhesive does not flow into the front of the LED patch lamp board 2 during the potting process, ensuring that the color of the LED light source is not changed. The process is thus suitable for mass production, and there is no air bubbles remaining. Moreover, the flame retardancy of the black adhesive reaches UL94V0, belongs to a filler of grade A, and meets the environmental protection requirements of Restriction of Hazardous Substances (ROHS) and Registration, Evaluation, Authorisation and restriction of Chemicals (REACH). Additionally, the black adhesive can be repaired, and can be used repeatedly after heating and melting, which will not cause waste, and it is suitable for products with a working temperature of −55° C. to 130° C.

The above embodiments are only preferred embodiments of the present invention and should not be considered to limit the scope of protection of the present invention. Therefore, all equivalent changes made in accordance with the structure, shape and principle of the present invention shall fall within the scope of protection of the present invention.

What is claimed is:

1. A lamp cap of a Christmas lamp, comprising a lamp cap housing, and a potting wick assembly arranged in the lamp cap housing; wherein the potting wick assembly comprises a patch lamp board, a lead wire, a transparent outer housing, and a potting adhesive; the lead wire is connected to the patch lamp board; at least one LED lamp bead is arranged on the patch lamp board; a receiving cavity is arranged in the transparent outer housing, and the patch lamp board is placed at a bottom of the receiving cavity; the lead wire is led out from one end of the receiving cavity, and the potting adhesive is potted into the receiving cavity.

2. The lamp cap of claim 1, wherein an outer wall of the transparent outer housing is provided with a limiting snap ring.

3. The lamp cap of claim 1, wherein the transparent outer housing comprises an enclosed light source scattering end, and an open end for potting; and the enclosed light source scattering end has a convex mirror structure.

4. The lamp cap of claim 1, wherein a center positioning block or an edge positioning block is arranged in the receiving cavity.

5. The lamp cap of claim 1, wherein the lamp cap housing comprises a left housing and a right housing, wherein the left housing and the right housing are connected to each other, and the left housing and the right housing are fixed through ultrasonic welding.

6. The lamp cap of claim 5, wherein an inner cavity is formed between the left housing and the right housing; the inner cavity comprises a lead wire cavity located on an upper part of the lamp cap housing, and a mounting cavity located at a lower part of the lamp cap housing; a positioning ring is arranged in the mounting cavity, and a joint between the lead wire cavity and the mounting cavity is provided with a step surface; and a fixed cavity for fixing a limiting snap ring is formed between the step surface and the positioning ring.

7. The lamp cap of claim 6, wherein the mounting cavity is provided with an internal thread located below the positioning ring.

8. The lamp cap of claim 7, wherein the left housing or the right housing is provided with at least one clamping portion.

9. The lamp cap of claim 1, wherein the potting adhesive is a modified asphalt, and the modified asphalt comprises the following components in parts by weight: 100 parts of asphalt, 5-10 parts of polyurethane resin, 8-10 parts of styrene-butadiene-styrene (SBS) rubber, 3-5 parts of inorganic fillers, 3-5 parts of tackifier by weight, 3-5 parts of softening oil by weight, 2-5 parts of antioxidant by weight, and 1-3 parts of nanofibers.

10. A production process for the lamp cap of claim 6, comprising the following steps:

step 1: manufacturing the potting wick assembly, comprising the following sub-steps:

sub-step 1-1: forming the transparent outer housing by pre-injection molding, wherein the transparent outer housing is formed from a polyvinyl chloride (PVC) material;

sub-step 1-2: placing the patch lamp board at the bottom of the receiving cavity of the transparent outer housing;

sub-step 1-3: enabling an adhesive potting gun by an adhesive potting apparatus to aim at an open end of the transparent outer housing and injecting the potting adhesive into the transparent outer housing to form a preliminary assembly; and sub-step 1-4: obtaining the potting wick assembly after naturally cooling and curing the preliminary assembly for five minutes;

step 2: manufacturing the lamp cap housing, and forming the left housing and the right housing by pre-injection molding, wherein the left housing and the right housing are matched with each other; and step 3: mounting the potting wick assembly into the lamp cap housing, and joining the left housing and the right housing by ultrasonic welding.

* * * * *